US008054250B2

(12) United States Patent
Kim

(10) Patent No.: US 8,054,250 B2
(45) Date of Patent: Nov. 8, 2011

(54) PIXEL, ORGANIC LIGHT EMITTING DISPLAY, AND DRIVING METHOD THEREOF

(75) Inventor: Yang Wan Kim, Yongin-si (KR)

(73) Assignee: Samsung Mobile Display Co., Ltd, Yongin (KR)

( * ) Notice: Subject to any disclaimer, the term of this patent is extended or adjusted under 35 U.S.C. 154(b) by 1009 days.

(21) Appl. No.: 11/781,162

(22) Filed: Jul. 20, 2007

(65) Prior Publication Data

US 2008/0036710 A1 Feb. 14, 2008

(30) Foreign Application Priority Data

Aug. 8, 2006 (KR) ..... 10-2006-0074589

(51) Int. Cl.
*G09G 3/30* (2006.01)

(52) U.S. Cl. ..... 345/76; 345/77; 345/83; 345/204; 345/211; 315/169.3

(58) Field of Classification Search ..... 345/76–83, 345/204, 211; 315/169.3; 313/483, 486, 313/505–507; 326/82–83; 327/108–112
See application file for complete search history.

(56) References Cited

U.S. PATENT DOCUMENTS

| | | | | |
|---|---|---|---|---|
| 6,989,826 | B2 | 1/2006 | Kasai | |
| 7,230,592 | B2 | 6/2007 | Sato et al. | |
| 2003/0016190 | A1 * | 1/2003 | Kondo | 345/55 |
| 2004/0017162 | A1 | 1/2004 | Sato et al. | |
| 2004/0104870 | A1 | 6/2004 | Mametsuka | |
| 2004/0145547 | A1 | 7/2004 | Oh | |
| 2005/0140600 | A1 * | 6/2005 | Kim et al. | 345/76 |
| 2005/0200575 | A1 * | 9/2005 | Kim et al. | 345/76 |
| 2005/0212446 | A1 | 9/2005 | Eom | |
| 2005/0285825 | A1 | 12/2005 | Eom et al. | |
| 2006/0055336 | A1 * | 3/2006 | Jeong | 315/169.3 |
| 2006/0124944 | A1 * | 6/2006 | Kwak | 257/96 |
| 2006/0231740 | A1 * | 10/2006 | Kasai | 250/214.1 |
| 2009/0027310 | A1 * | 1/2009 | Kim | 345/76 |
| 2011/0102403 | A1 * | 5/2011 | Kim | 345/211 |

FOREIGN PATENT DOCUMENTS

CN 1496204 A 5/2004

(Continued)

OTHER PUBLICATIONS

Japanese Office action dated Mar. 2, 2010, for corresponding Japanese Patent application 2006-262952, noting listed references in this IDS.

(Continued)

*Primary Examiner* — Lun-Yi Lao
*Assistant Examiner* — Priyank Shah
(74) *Attorney, Agent, or Firm* — Christie, Parker & Hale, LLP

(57) ABSTRACT

A pixel, an organic light emitting display, and a method for driving an organic light emitting display using the pixel, which can display an image with substantially uniform luminance. In one embodiment, the method for driving an organic light emitting display having a pixel disposed at an i-th horizontal line, the pixel having a drive transistor for enabling the flow of current to an organic light emitting diode, the method including providing a reference voltage to a gate electrode of the drive transistor, charging a second capacitor with a threshold voltage of the drive transistor, charging a first capacitor with a voltage corresponding to a data signal, and providing a current corresponding to the voltages in the first and second capacitors to the organic light emitting diode.

17 Claims, 5 Drawing Sheets

FOREIGN PATENT DOCUMENTS

| | | | |
|---|---|---|---|
| CN | 1601594 | A | 3/2005 |
| CN | 1742309 | A | 3/2006 |
| EP | 1758085 | A2 | 2/2007 |
| JP | 2002-514320 | | 5/2002 |
| JP | 2003-122301 | | 4/2003 |
| JP | 2003-173165 | | 6/2003 |
| JP | 2004-133240 | | 4/2004 |
| JP | 2004-246204 | | 9/2004 |
| JP | 2005-258407 | | 9/2005 |
| JP | 2006-018277 | | 1/2006 |
| JP | 2006-53587 | | 2/2006 |
| JP | 2006-516745 | | 7/2006 |
| JP | 2006-301159 | | 11/2006 |
| KR | 10-2005-0049686 | | 5/2005 |
| KR | 10-2005-0110458 | | 11/2005 |
| KR | 10-2006-0000439 | | 1/2006 |
| WO | WO 98/48403 | | 10/1998 |
| WO | WO 2004/066249 | A1 | 8/2004 |
| WO | WO 2006/054189 | A1 | 5/2006 |

OTHER PUBLICATIONS

European Search Report dated Nov. 12, 2007, for corresponding European Patent Application EP 07114036.2, indicating relevance of references in this IDS.

Choi, S. et al, *P-11: An Improved Voltage Programmed Pixel Structure for Large Size and High Resolution AM-OLED Displays*; SID 04 Digest, vol. 35, PRT 1, May 25, 2004, pp. 260-263, XP001222795.

Patent Abstracts of Japan, Publication No. 2006-053587, Published on Feb. 23, 2006, in the name of Miyazawa.

Korean Patent Abstracts, Publication No. 1020050049686 A, Published on May 27, 2005, in the name of Kim.

Korean Patent Abstracts, Publication No. 1020050110458 A, Published on Nov. 23, 2005, in the name of Chung.

Korean Patent Abstracts, Publication No. 1020060000439 A, Published on Jan. 6, 2006, in the name of Eom et al.

Patent Abstracts of Japan, Publication No. 2003-122301, dated Apr. 25, 2003, in the name of Hajime Akimoto et al.

Patent Abstracts of Japan, Publication No. 2003-173165, dated Aug. 20, 2003, in the name of Yoshiaki Aoki.

EPO Patent Certificate for 1 887 552 B1 dated Oct. 20, 2010 in corresponding European Application No. 07114036.2, listing the references in this IDS as well as the references in an IDS filed on Feb. 11, 2008.

Chinese Patent Certificate for ZL200710138693.0 dated Dec. 15, 2010 in corresponding Chinese Application No. 200710138693.0, listing the references in this IDS as well as the references in an IDS filed on Feb. 11, 2008 and Feb. 20, 2008.

* cited by examiner

PIXEL, ORGANIC LIGHT EMITTING DISPLAY, AND DRIVING METHOD THEREOF

CROSS-REFERENCE TO RELATED APPLICATIONS

This application claims priority to and the benefit of Korean Patent Application No. 10-2006-0074589, filed on Aug. 8, 2006, in the Korean Intellectual Property Office, the entire content of which is incorporated herein by reference.

BACKGROUND

1. Field of the Invention

The present invention relates to a pixel, an organic light emitting display, and a method for driving the organic light emitting display including the pixel.

2. Discussion of Related Art

Recently, various flat panel displays having advantages such as reduced weight and volume over cathode ray tubes (CRT) displays have been developed. Flat panel displays include liquid crystal displays (LCD), field emission displays (FED), plasma display panels (PDP), and organic light emitting displays.

Among the flat panel displays, the organic light emitting displays make use of organic light emitting diodes that emit light by re-combination of electrons and holes. The organic light emitting display has advantages such as high response speed and low power consumption.

FIG. 1 is a circuit diagram showing a pixel 4 of a conventional organic light emitting display.

With reference to FIG. 1, the pixel 4 of a conventional organic light emitting display includes an organic light emitting diode (OLED) and a pixel circuit 2. The pixel circuit 2 is coupled to a data line Dm and a scan line Sn, and controls light emission of the organic light emitting diode (OLED).

An anode electrode of the organic light emitting diode (OLED) is coupled to a pixel circuit 2, and a cathode electrode thereof is coupled to a second power supply ELVSS. The organic light emitting diode (OLED) generates light of a predetermined luminance corresponding to an electric current from the pixel circuit 2.

When a scan signal is supplied to the scan line Sn, the pixel circuit 2 controls the amount of electric current provided to the organic light emitting diode (OLED). The amount of current corresponds to a data signal provided to the data line Dm. The pixel circuit 2 includes a second transistor M2, a first transistor M1, and a storage capacitor Cst. The second transistor M2 is coupled to a first power supply ELVDD and the organic light emitting diode (OLED). The first transistor M1 is coupled between the data line Dm and the scan line Sn. The storage capacitor Cst is coupled between a gate electrode and a first electrode of the second transistor M2.

A gate electrode of the first transistor M1 is coupled to the scan line Sn, and a first electrode thereof is coupled to the data line Dm. A second electrode of the first transistor M1 is coupled with one terminal of the storage capacitor Cst. The first electrode can be either a source electrode or a drain electrode, and the second electrode is the other one of the source electrode or the drain electrode. For example, when the first electrode is the source electrode, the second electrode is the drain electrode. When a scan signal is supplied to the first transistor M1 coupled with the scan line Sn and the data line Dm, the first transistor M1 is turned-on to provide a data signal from the data line Dm to the storage capacitor Cst. At this time, the storage capacitor Cst is charged with a voltage corresponding to the data signal.

The gate electrode of the second transistor M2 is coupled to one terminal of the storage capacitor Cst, and a first electrode thereof is coupled to another terminal of the storage capacitor Cst and a first power supply ELVDD. Further, a second electrode of the second transistor M2 is coupled with the anode electrode of the organic light emitting diode (OLED). The second transistor M2 controls the amount of electric current flowing from the first power supply ELVDD to a second power supply ELVSS through the organic light emitting diode such that the current corresponds to the voltage charged in the storage capacitor Cst. At this time, the organic light emitting diode (OLED) emits light corresponding to the amount of electric current supplied from the second transistor M2.

However, the pixel 4 of the conventional organic light emitting display may not display an image of substantially uniform luminance. Threshold voltages of the second transistors M2 (drive transistors) in the pixels 4 vary according to process deviations during fabrication. When the threshold voltages of the second transistors M2 vary, although data signals corresponding to the same luminance are supplied to the pixels 4, the organic light emitting diodes (OLEDs) emit light of different luminance due to variations in the threshold voltages of the second transistors M2.

SUMMARY OF THE INVENTION

Accordingly, one exemplary embodiment of the present invention to provides a plurality of pixels, an organic light emitting display, and a method for driving an organic light emitting display using the pixels, which may display an image of substantially uniform luminance irrespective of the threshold voltages of transistors included in the pixels.

A second embodiment of the present invention provides a pixel coupled to a first scan line, a second scan line and a third scan line, the pixel including an organic light emitting diode, a first transistor configured to be turned-on when a scan signal is supplied to the first scan line for transferring a data signal, a second transistor configured to allow an electric current corresponding to the data signal to flow from a first power supply to a second power supply through the organic light emitting diode, a second capacitor disposed between the first and second transistors, and configured to be charged with a voltage corresponding to a voltage drop of the first power supply and a threshold voltage of the second transistor, a first capacitor coupled between the second capacitor and the first power supply, the first capacitor being configured to be charged with a voltage corresponding to the data signal, a fourth transistor coupled between a second electrode of the first transistor and a reference power supply, the fourth transistor being configured to be turned-on when the scan signal is supplied to the second scan line, a third transistor coupled between a gate electrode and a second electrode of the second transistor, and a fifth transistor coupled between the gate electrode of the second transistor and the reference power supply, the fifth transistor being configured to be turned-on when the scan signal is supplied to the third scan line, wherein the second scan line is a previous scan line of the first scan line and the third scan line is previous scan line to the second scan line.

A third embodiment of the present invention provides an organic light emitting display including a scan driver for sequentially providing a scan signal to scan lines, and for sequentially providing an emission control signal to emission control lines, a data driver for providing a data signal to data lines in synchronization with the scan signal and a plurality of pixels, each being coupled to one of the data lines and a first, a second and a third scan line among the scan lines, each of the pixels including an organic light emitting diode, a first transistor configured to be turned-on when a scan signal is supplied to the first scan line for transferring a data signal, a second transistor configured to allow an electric current corresponding to the data signal to flow from a first power supply to a second power supply through the organic light emitting diode, a second capacitor disposed between the first and second transistors, and configured to be charged with a voltage corresponding to a voltage drop of the first power supply and a threshold voltage of the second transistor, a first capacitor coupled between the second capacitor and the first power supply, the first capacitor being configured to be charged with a voltage corresponding to the data signal, a fourth transistor coupled between a second electrode of the first transistor and a reference power supply, the fourth transistor being configured to be turned-on when the scan signal is supplied to the second scan line, a third transistor coupled between a gate electrode and a second electrode of the second transistor, and a fifth transistor coupled between the gate electrode of the second transistor and the reference power supply, the sixth transistor being configured to be turned-on when the scan signal is supplied to the third scan line, wherein the second scan line is a previous scan line of the first scan line and the third scan line is previous scan line to the second scan line.

A fourth embodiment of the present invention provides a method for driving an organic light emitting display comprising a pixel disposed at an i-th horizontal line (where, 'i' is an integer) where the pixel has a drive transistor for controlling the flow of an electric current to an organic light emitting diode, the method including providing a reference voltage to a gate electrode of the drive transistor when a scan signal is supplied to an (i−2)th scan line, charging a second capacitor with a threshold voltage of the drive transistor when the scan signal is supplied to an (i−1)th scan line, charging a first capacitor with a voltage corresponding to a data signal when the scan signal is supplied to an i-th scan line, and providing the electric current corresponding to the voltages in the first and second capacitors to the organic light emitting diode.

BRIEF DESCRIPTION OF THE DRAWINGS

These and/or other aspects and features of the invention will become apparent and more readily appreciated from the following description of the embodiments, taken in conjunction with the accompanying drawings of which.

DETAILED DESCRIPTION

Figure 1:
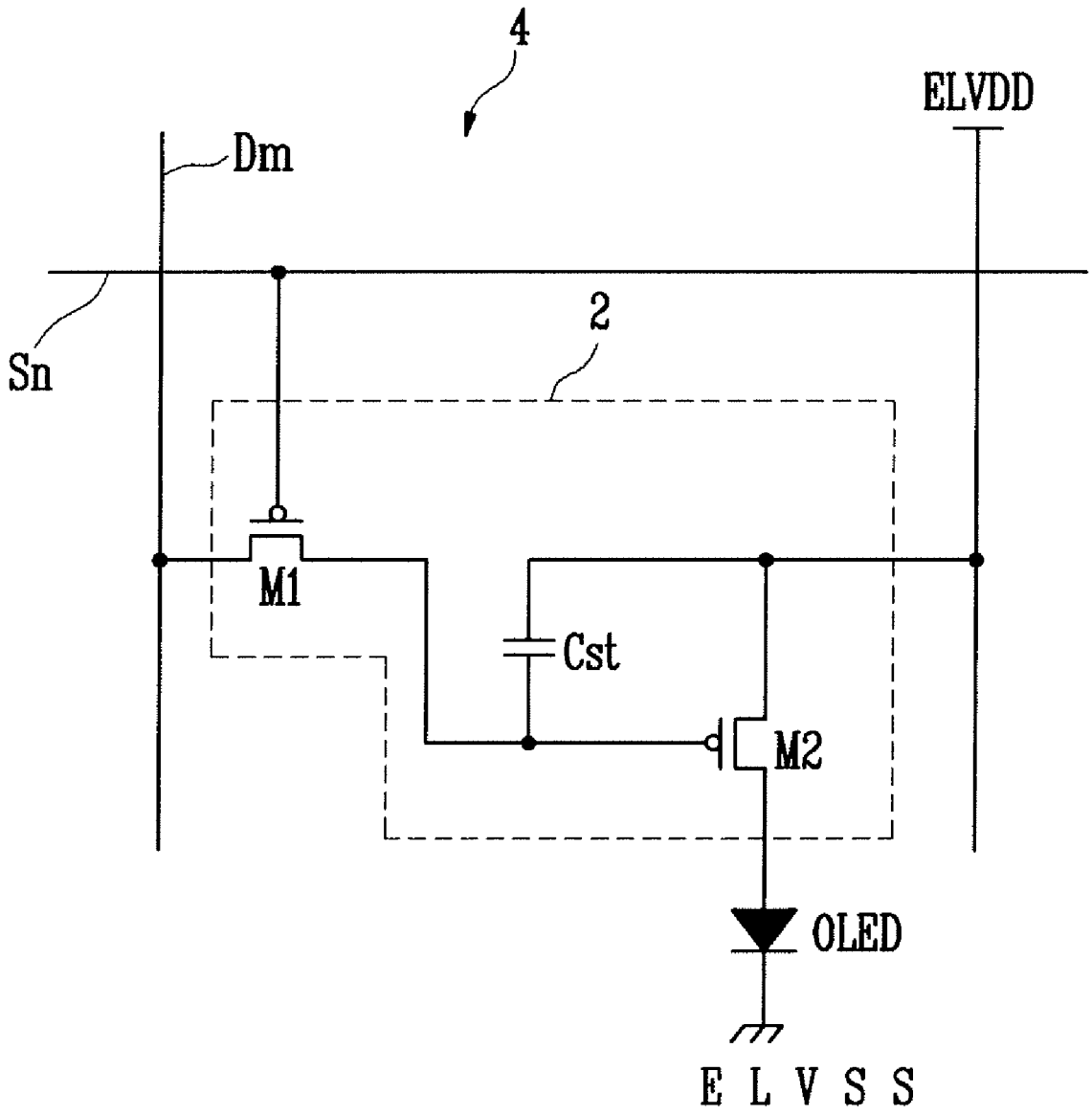
FIG. 1 (PRIOR ART)
FIG. 1 is a circuit diagram showing a conventional pixel.

Hereinafter, exemplary embodiments according to the present invention will be described with reference to the accompanying drawings. Here, when one element is referred to as being connected to a second element, the one element may be not only directly connected to the second element but instead may be indirectly connected to the second element via another element. Further, some elements not necessary for a complete description are omitted for clarity. Also, like reference numerals refer to like elements throughout.

Figure 2:
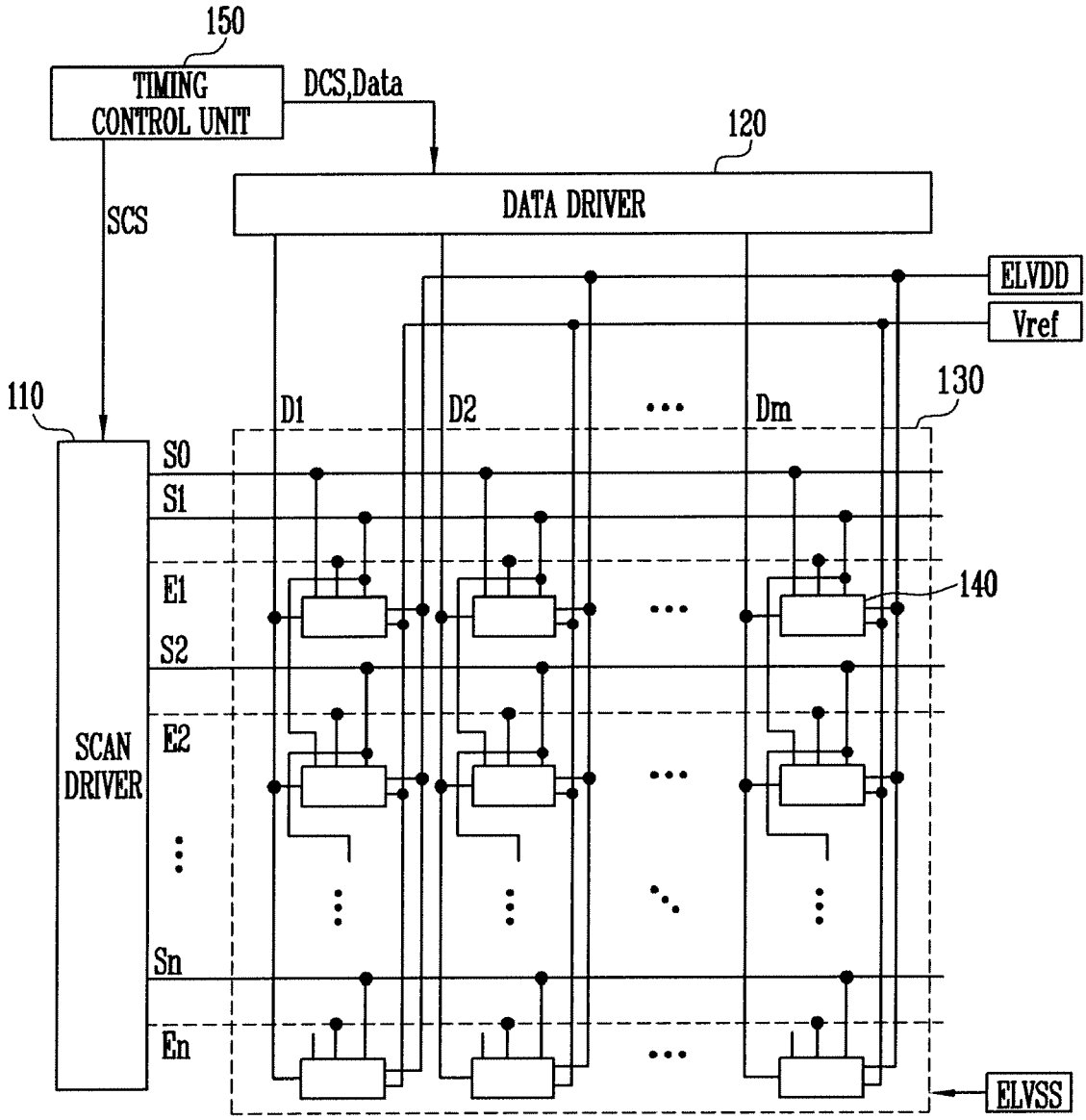
FIG. 2 is a schematic diagram showing an organic light emitting display according to a first embodiment of the present invention.

FIG. 2 is a schematic diagram showing an organic light emitting display according to a first embodiment of the present invention With reference to FIG. 2, the organic light emitting display, according to a first embodiment of the present invention, includes a pixel region 130, a scan driver 110, a data driver 120, and a timing control unit 150. The pixel region 130 includes a plurality of pixels 140, which are coupled with scan lines S1 to Sn, emission control lines E1 to En, and data lines D1 to Dm. The scan driver 110 drives the scan lines S1 to Sn and the emission control lines E1 to En. The data driver 120 drives the data lines D1 to Dm. The timing control unit 150 controls the scan driver 110 and the data driver 120.

The pixel region 130 includes the pixels 140, which are formed at areas defined by the scan lines S1 to Sn, the emission control lines E1 to En, and the data lines D1 to Dm. The pixels 140 receive a voltage from a first power supply ELVDD, a voltage from a second power supply ELVSS, and a voltage from an exterior reference power supply Vref. Each of the pixels 140, having received the voltage from Vref, compensates for the voltage drop of the first power supply ELVDD and a threshold voltage of a drive transistor using a difference between the voltage of the first power supply ELVDD and the voltage of the reference power supply Vref.

Further, the pixels 140 provide an electric current, which may be predetermined, from the first power supply ELVDD to the second power supply ELVSS through an organic light emitting diode (shown in FIG. 3) according to a data signal supplied thereto. Accordingly, the organic light emitting diode emits light of a predetermined luminance (e.g. predetermined luminance).

In practice, each of the pixels 140 is coupled with two scan lines to be driven. In other words, when a scan signal is supplied to an (i−1)th ('i' is an integer) scan line Si−1, a pixel 140 disposed at an i-th horizontal line performs an initialization and a compensation of a threshold voltage. Moreover, when the scan signal is supplied to an (i)th scan line Si, the pixel 140 is charged with a voltage corresponding to the data signal. The organic light emitting display of FIG. 2 includes a zero-th scan line S0 coupled to pixels 140 at a first horizontal line.

The timing control unit 150 generates a data drive control signal DCS and a scan drive control signal SCS according to externally supplied synchronous signals. The data drive control signal DCS generated by the timing control unit 150 is provided to the data driver 120, and the scan drive control signal SCS is provided to the scan driver 110. Furthermore, the timing control unit 50 provides externally supplied data (Data) to the data driver 120.

The scan driver 110 generates a scan signal in response to a scan drive control signal (SCS) from the timing control unit 150, and sequentially provides the generated scan signal to the scan lines S1 to Sn. Then, the scan driver 110 sequentially provides an emission control signal to the emission control lines E1 to En. The emission control signal is activated such that it overlaps with two scan signals during at least a part of the activated time period. Thus, time period of activation for the emission control signal is equal to or greater than that of the first scan signal.

The data driver 120 receives the data drive control signal DCS from the timing control unit 150, and generates a data signal (electric current) which may be predetermined. The data driver controls an electric current corresponding to the generated data signals to flow through the data lines D1 to Dm.

Figure 3:
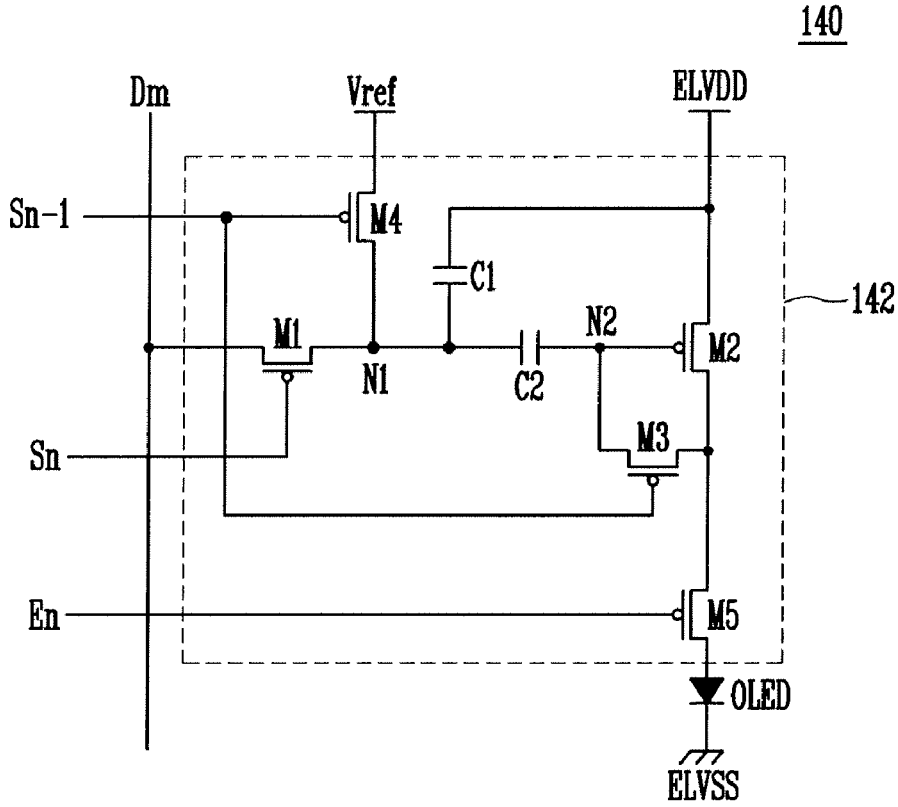
FIG. 3 is a circuit diagram showing an example of the pixel shown in FIG. 2.

FIG. 3 is a circuit diagram showing an example of the pixel shown in FIG. 2. For convenience of description, FIG. 3 shows a single pixel, which is positioned at an n-th horizontal line and is coupled with an m-th data line Dm.

With reference to FIG. 3, the pixel 140 in one embodiment of the present invention includes an organic light emitting diode (OLED) and a pixel circuit 142 for supplying an electric current to the organic light emitting diode (OLED).

The organic light emitting diode (OLED) emits light having a color (e.g., a predetermined color) corresponding to the electric current from the pixel circuit 142. For example, the organic light emitting diode (OLED) generates red, green, or blue light having a luminance corresponding to the amount of the electric current supplied by the pixel circuit 142.

When the scan signal is supplied to an (n−1)th scan line Sn−1, the pixel circuit 142 compensates for a voltage drop of the first power supply ELVDD and a threshold voltage of the second transistor M2 (drive transistor). When the scan signal is provided to the n-th scan line Sn, the pixel circuit 142 is charged with a voltage corresponding to the data signal. So as to do this, the pixel circuit 142 includes first to fifth transistors M1 to M5, and first and second capacitors C1 and C2.

A first electrode of the first transistor M1 is coupled to a data line Dm, and a second electrode thereof is coupled with a first node N1. Further, the gate electrode of the first transistor M1 is coupled to the n-th scan line Sn. When the scan signal is supplied to the n-th scan line Sn, the first transistor M1 is turned-on to electrically connect the data line Dm and the first node N1 to each other.

A first electrode of the second transistor M2 is coupled with the first power supply ELVDD, and a second electrode thereof is coupled with a first electrode of the fifth transistor M5. Further, a gate electrode of the second transistor M2 is coupled with a second node N2. The second transistor M2 provides an electric current to a first electrode of the fifth transistor M5 where the current corresponds to a voltage applied to the second node N2, namely, a voltage charged in the first and second capacitors C1 and C2.

A second electrode of the third transistor M3 is coupled to the second node N2, and a first electrode thereof is coupled with the second electrode of the second transistor M2. Moreover, a gate electrode of the third transistor M3 is coupled to the (n−1)th scan line Sn−1. When the scan signal is supplied to the (n−1)th scan line Sn−1, the third transistor M3 is turned-on to diode-connect the second transistor M2.

A first electrode of the fourth transistor M4 is coupled to the reference power supply Vref, and a second electrode thereof is coupled to the first node N1. In addition, a gate electrode of the fourth transistor M4 is coupled to the (n−1)th scan line Sn−1. When the scan signal is provided to the (n−1)th scan line Sn−1, the fourth transistor M4 is turned-on to electrically connect the first node N1 to the reference power supply Vref.

A first electrode of the fifth transistor M5 is coupled to the second electrode of the second transistor M2, and a second electrode thereof is coupled to an anode electrode of the organic light emitting diode (OLED). Further, a gate electrode of the fifth transistor M5 is coupled with an n-th emission control line. When an emission control signal is provided to the n-th emission control line En, the fifth transistor M5 is turned-off. In contrast to this, when the emission control signal is not supplied, the fifth transistor M5 is turned-on. Here, the emission control signal supplied to the n-th emission control line En partially overlaps with a scan signal supplied to the (n−1)th scan line Sn−1, and completely overlaps with a scan signal supplied to the n-th scan line Sn. Accordingly, while the first capacitor C1 and the second capacitor C2 are being charged with a voltage (e.g., a predetermined voltage), the fifth transistor M5 is turned-off. In contrast to this, during remaining time periods, the fifth transistor M5 electrically connects the second transistor M2 to the organic light emitting diode (OLED).

The first power supply ELVDD is coupled to the pixels 140, and supplies a current thereto. Accordingly, voltage drops vary according to the positions of the pixels 140. However, the reference power supply Vref does not provide an electric current to the pixels 140, thereby maintaining the same voltage value regardless of the positions of the pixels 140. The voltage values of the first power supply ELVDD and the reference power supply Vref can be equally set to each other.

Figure 4:
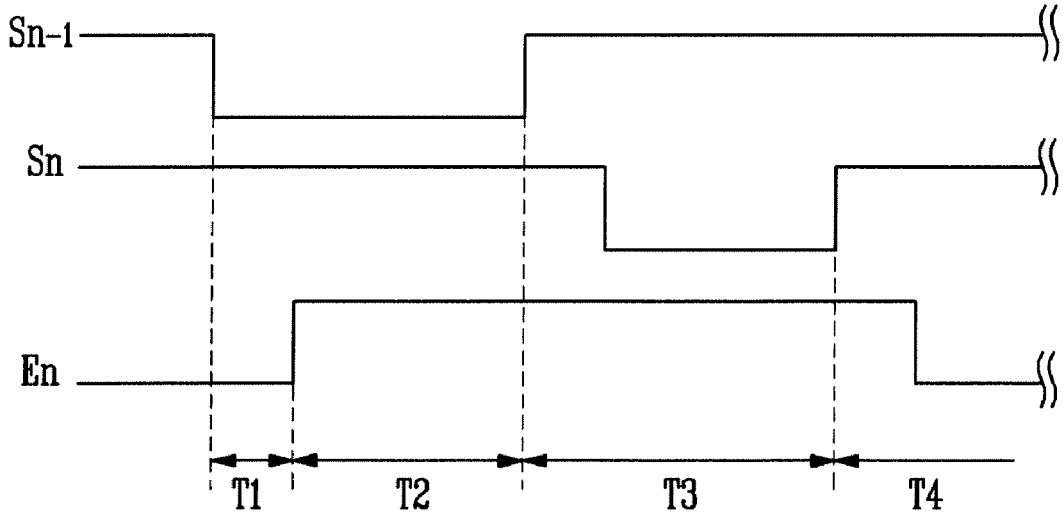
FIG. 4 is a waveform diagram showing a method of driving the pixel shown in FIG. 3.

FIG. 4 is a waveform diagram showing a method of driving the pixel shown in FIG. 3.

Referring to FIG. 4, the fifth transistor M5 maintains a turned-on state during a first time period T1, which is a part of a time period when the scan signal is supplied to the (n−1)th scan line Sn−1. Further, during the first time period T1, the third transistor M3 and the fourth transistor M4 are turned-on.

When the third transistor M3 is turned-on, a gate electrode of the second transistor M2 is electrically connected to the organic light emitting diode (OLED) through the third transistor M3. Accordingly, a voltage of the gate electrode of the second transistor M2, namely, the second node N2, is initialized with a voltage of the second power supply ELVDD. That is, the first time period T1 is used to initialize a voltage of the second node N2.

Next, during a second time period T2 of a time period when the scan signal is supplied to the (n−1)th scan line Sn−1 other than the first time period, the fifth transistor M5 is turned-off by an emission control signal supplied to an n-th emission control line En. Accordingly, a voltage obtained by subtracting a threshold voltage of the second transistor M2 from a voltage of the first power supply ELVDD, is applied to a gate electrode of the second transistor M2, which is diode-connected by the third transistor M3.

Further, the first node N1 is set as a voltage of the reference power supply Vref by the fourth transistor M4, which has maintained turning-on state during the second time period T2. Here, assuming that voltages of the reference power supply Vref and the first power supply ELVDD are identical with each other, the second capacitor C2 is charged with a voltage corresponding to a threshold voltage of the second transistor M2. Moreover, when a voltage drop occurs in the first power supply ELVDD, the second capacitor C2 is charged with a threshold voltage of the second transistor M2 and the voltage drop of the first power supply ELVDD. That is, the second capacitor C2 is charged with a threshold voltage of the second transistor M2 and the voltage drop of the first power supply ELVDD, and accordingly the threshold voltage of the second transistor M2 and the voltage drop of the first power supply ELVDD can be concurrently compensated.

Then, during a third time period T3, the scan signal is provided to the n-th scan line Sn. When the scan signal is supplied to the n-th scan line Sn, the first transistor M1 is turned-on. When the first transistor M1 is turned-on, a data signal is supplied to the first node N1. Accordingly, a voltage of the first node N1 drops to a voltage of the data signal from a voltage of the reference power supply Vref. A voltage of the second node N2 set as a floating state during the third time period T3 also drops corresponding to a voltage drop of the first node N1. Namely, during the third time period T3, a voltage charged in the second capacitor C2 is stably maintained. On the other hand, during the third time period T3, the third capacitor C1 is charged with a predetermined voltage corresponding to the data signal, which is applied to the first node N1.

Thereafter, during a fourth time period T4, after the supply of the scan signal to the n-th scan line stops, the supply of the emission control signal to the n-th emission control line En is terminated. When the supply of the emission control signal stops, the fifth transistor M5 is turned-on. When the fifth transistor M5 is turned-on, the second transistor M2 provides an electric current to the organic light emitting diode (OLED) corresponding to the voltages charged in the first capacitor C1 and the second capacitor C2, so that the light emitting diode (OLED) generates light having a luminance corresponding to the current.

As illustrated earlier, the pixel 140 shown in FIG. 3 is capable of displaying a desired image irrespective of the threshold voltage of the drive transistor M2 and the voltage drop of the first power supply ELVDD. However, during a short time period when the scan signal is supplied to one scan line, the pixel 140 is initialized and the threshold voltage of the drive threshold voltage is compensated, thereby causing display quality to be deteriorated.

In detail, during the first time period T1, which is a part of a time period when the scan is supplied to the (n−1)th scan line Sn−1, the pixel 140 initializes the second node N2. During a second time period T2 among a time period when the scan is supplied to the (n−1)th scan line Sn−1 other than the first time period T1, the second capacitor C2 is charged with a voltage corresponding the threshold voltage of the second transistor M2. During the second time period T2 set as a short time period, the voltage corresponding to the threshold voltage of the second transistor M2 may be insufficiently charged. In particular, as the size of the panel is increased and the resolution becomes higher, the second time period T2 becomes shorter.

On the other hand, during the first time period T1, a voltage of the second node N2 is approximately initialized with a voltage of the second power supply ELVSS. Here, the initialized voltage of the second node N2 can vary for different pixels based on the voltage drop of the second power supply ELVSS. When the initialized voltage of the second node N2 varies, the voltage of the second node N2 is not changed to a desired value during the second time period T2, which may result in the display of a non-uniform image. Further, in the pixel shown in FIG. 3, a current may be supplied to the organic light emitting diode during the first time period T1 so as to generate undesirable light.

Figure 5:
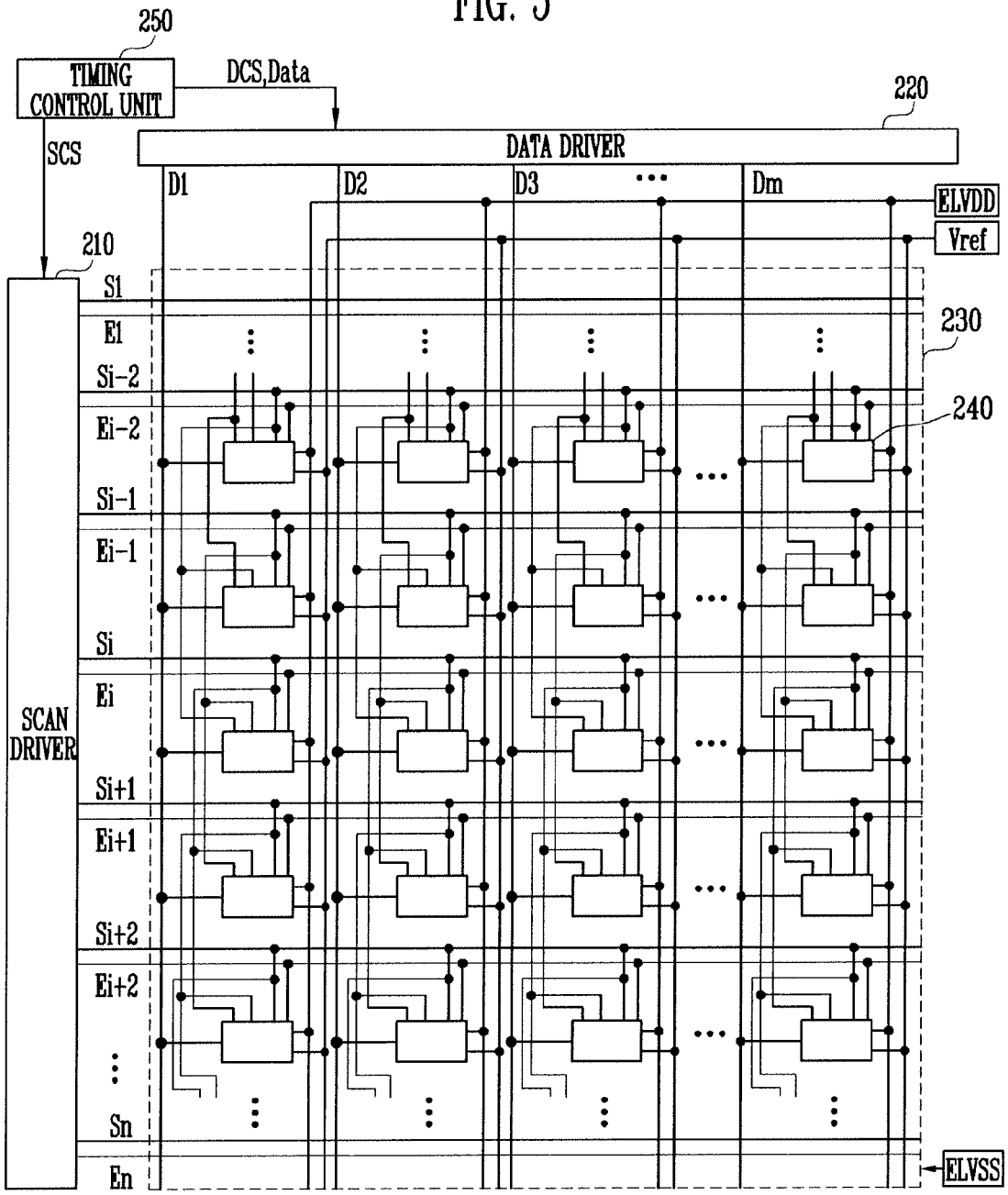
FIG. 5 is a schematic diagram showing an organic light emitting display according to a second embodiment of the present invention.

FIG. 5 is a schematic diagram showing an organic light emitting display according to a second embodiment of the present invention.

With reference to FIG. 5, the organic light emitting display according to the second embodiment of the present invention includes a pixel region 230, a scan driver 210, a data driver 220, and a timing control unit 250. The pixel region 230 includes a plurality of pixels 240, which are coupled with scan lines S1 to Sn, emission control lines E1 to En, and data lines D1 to Dm. The scan driver 210 drives the scan lines S1 to Sn and the emission control lines E1 to En. The data driver 220 drives the data lines D1 to Dm. The timing control unit 150 controls the scan driver 210 and the data driver 220.

The pixel region 230 includes the pixels, which are formed at areas defined by the scan lines S1 to Sn, the emission control lines E1 to En, and the data lines D1 to Dm. The pixels 240 receive a voltage from the first power supply ELVDD, a voltage from the second ELVSS, and an exterior voltage from a reference power supply Vref. Each of the pixels 240 having received the voltage of the reference power supply Vref compensates for a voltage drop of the first power supply ELVDD and a threshold voltage of a drive transistor using a difference between the voltage of the first power supply ELVDD and the voltage of the reference power supply Vref.

Further, the pixels 240 provide an electric current from the first power supply ELVDD to the second power supply ELVSS through an organic light emitting diode (shown in FIG. 6) according to a data signal supplied thereto. Accordingly, the organic light emitting diode emits light having a luminance (e.g., a predetermined luminance).

The pixels 240 are coupled with three scan lines to be driven. In other words, when a scan signal is supplied to an (i−2)th ('i' is integer) scan line Si−2, a pixel 240 disposed at an i-th horizontal line is initialized. When the scan signal is supplied to an (i−1)th scan line Si−1, a pixel 140 disposed at an i-th horizontal line performs an initialization and a compensation of a threshold voltage. Moreover, when the scan signal is supplied to an i scan line Si, the pixel 140 is charged with a voltage corresponding to the data signal.

The timing control unit 250 generates a data drive control signal DCS and a scan drive control signal SCS according to externally supplied synchronous signals. The data drive control signal DCS generated by the timing control unit 250 is provided to the data driver 220, and the scan drive control signal SCS is provided to the scan driver 210. Furthermore, the timing control unit 50 provides externally supplied data (Data) to the data driver 220.

The scan driver 210 generates a scan signal in response to a scan drive control signal SCS from the timing control unit 250, and sequentially provides the generated scan signal to the scan lines S1 to Sn. Then, the scan driver 210 sequentially provides an emission control signal to the emission control lines E1 to En. The emission control signal is activated such that it overlaps with three scan signals. In other words, the emission control signal is supplied to the i-th emission control line Ei to overlap with the scan signals, which are supplied to the (i−2)th scan line Si−2, the (i−1)th scan line Si−1, and the i-th scan line Si.

The data driver 220 receives the data drive control signal DCS from the timing control unit 250, and generates a data signal (electric current), which may be predetemined. The data driver controls electric current corresponding to the generated data signals to flow through the data lines D1 to Dm.

Figure 6:
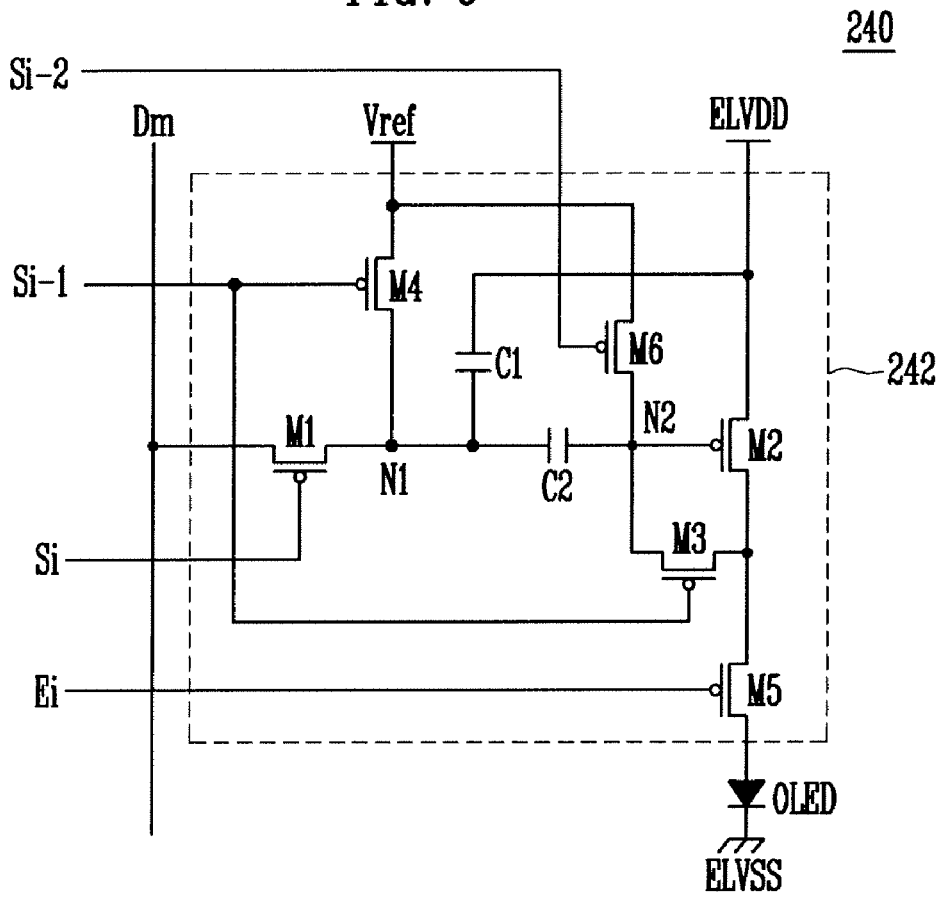
FIG. 6 is a circuit diagram showing an example of the pixel shown in FIG. 5.

FIG. 6 is a circuit diagram showing an example of the pixel shown in FIG. 5. For convenience of description, FIG. 6 shows a single pixel, which is positioned at an i-th horizontal line and is coupled with an m-th data line Dm.

With reference to FIG. 6, the pixel 240 in one embodiment of the present invention includes an organic light emitting diode (OLED) and a pixel circuit 242 for supplying an electric current to the organic light emitting diode (OLED).

The organic light emitting diode (OLED) emits light having a color (e.g., predetermined color) corresponding to the electric current from the pixel circuit 242. For example, the organic light emitting diode (OLED) generates red, green, or blue light having a luminance corresponding to the amount of the electric current supplied by the pixel circuit 242.

When the scan signal is supplied to an (i−2)th scan line Si−2, the pixel circuit 242 initializes a second node N2. Further, when the scan signal is supplied to an (i−1)th scan line Si−1, the pixel circuit 242 compensates for a voltage drop of the first power supply ELVDD and a threshold voltage of the second transistor M2 (drive transistor). In order to do this, a voltage of the reference power supply Vref is set to be greater than a voltage of the data signal, and to be less than a voltage of the first power supply ELVDD.

When the scan signal is provided to an i-th scan line Si, the pixel circuit 242 is charged with a voltage corresponding to the data signal. To do this, the pixel circuit 142 includes first to sixth transistors M1 to M6, and first and second capacitors C1 and C2.

A first electrode of the first transistor M1 is coupled to the data line Dm, and a second electrode thereof is coupled with a first node N1. Further, a gate electrode of the first transistor M1 is coupled to an i-th scan line Si. When the scan signal is supplied to the i-th scan line Si, the first transistor M1 is turned-on to electrically connect the data line Dm and the first node N1 to each other.

A first electrode of the second transistor M2 is coupled with the first power supply ELVDD, and a second electrode thereof is coupled with a first electrode of the fifth transistor M5. Further, a gate electrode of the second transistor M2 is coupled with a second node N2. The second transistor M2 provides an electric current to the first electrode of the fifth transistor M5 where the electric current corresponds to a voltage applied to the second node N2, namely, a voltage charged in the first and second capacitors C1 and C2.

A second electrode of the third transistor M3 is coupled to the second node N2, and a first electrode thereof is coupled with the second electrode of the second transistor M2. Moreover, a gate electrode of the third transistor M3 is coupled to the (i−1)th scan line Si−1. When the scan signal is supplied to the (i−1)th scan line Si−1, the third transistor M3 is turned-on to diode-connect the second transistor M2.

A first electrode of the fourth transistor M4 is coupled to the reference power supply Vref, and a second electrode thereof is coupled to the first node N1. In addition, a gate electrode of the fourth transistor M4 is coupled to an (i−1)th scan line Si−1. When the scan signal is provided to the (i−1)th scan line Si−1, the fourth transistor M4 is turned-on to electrically connect the first node N1 to the reference power supply Vref.

A first electrode of the fifth transistor M5 is coupled to the second electrode of the second transistor M2, and a second electrode thereof is coupled to an anode electrode of the organic light emitting diode (OLED). Further, a gate electrode of the fifth transistor M5 is coupled with an n-th emission control line. When an emission control signal is provided to an i-th emission control line Ei, the fifth transistor M5 is turned-off. In contrast to this, when the emission control signal is not supplied, the fifth transistor M5 is turned-on.

A first electrode of the sixth transistor M6 is coupled to the reference power supply Vref, and a second electrode thereof is coupled to the second node N2. Further, a gate electrode of the sixth transistor M6 is coupled with an (i−2)th scan line Si−2. When the scan signal is supplied to the (i−2)th scan line Si−2, the sixth transistor M6 is turned-on to electrically connect the second node N2 to the reference power supply Vref.

Figure 7:
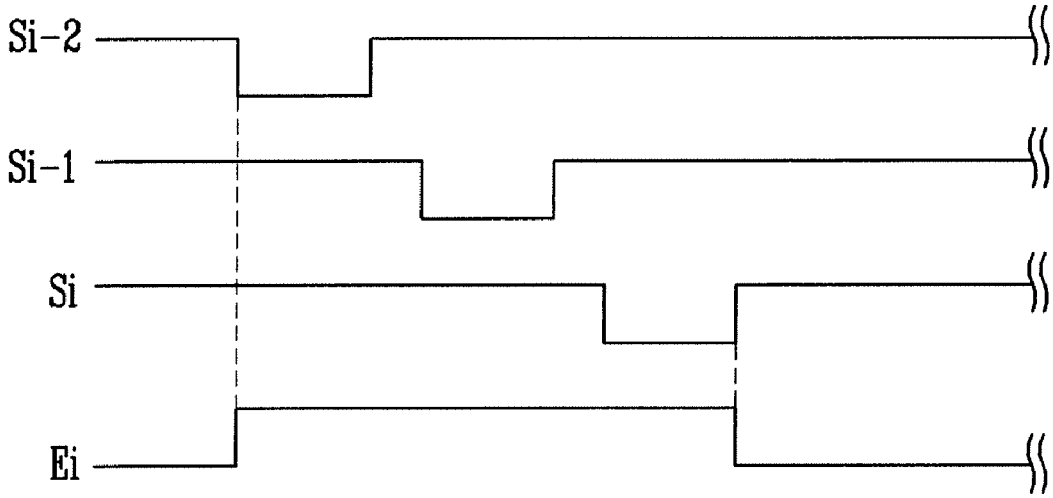
FIG. 7 is a waveform diagram showing a method of driving the pixel shown in FIG. 6.

FIG. 7 is a waveform diagram showing a method of driving the pixel shown in FIG. 6.

Referring to FIG. 7, firstly, the scan signal is provided to the (i−2)th scan line Si−2. When the scan signal is provided to the (i−2)th scan line Si−2, the sixth transistor M6 is turned-on. When the sixth transistor M6 is turned-on, a voltage of the reference power supply Vref is supplied to the second node N2. Namely, when the scan signal is provided to the (i−2)th scan line Si−2, a voltage of the second node N2 is initialized with the voltage of the reference power supply Vref. Accordingly, all pixels 240 included in the pixel region 230 receive the same voltage in the second node N2 at an initialization step. In other words, because the second node N2 is initialized using the reference power supply Vref in which a voltage drop does not occur, each of the second nodes N2 of the pixels 240 may be initialized with the same voltage regardless of the locations of the pixels 240 in the pixel region 230.

Next, the scan signal is provided to the (i−1)th scan line Si−1. When the scan signal is provided to the (i−1)th scan line Si−1, the third transistor M3 and the fourth transistor M4 are turned-on. When the third transistor M3 is turned-on, the second transistor M2 is diode-connected. Here, the second node N2 is initialized with a voltage of the reference power supply Vref that is less than a voltage of the first power supply ELVDD and the second transistor M2 is turned-on, so that a voltage obtained by subtracting a threshold voltage of the second transistor M2 from a voltage of the first power supply ELVDD is applied to the second node N2.

When the fourth transistor M4 is turned-on, a voltage of the reference power supply Vref is applied to the first node N1. Accordingly, the second capacitor C2 is charged with a voltage including a voltage drop of the first power supply ELVDD and a threshold voltage of the second transistor M2.

Then, the scan signal is provided to an i-th scan line Si. When the scan signal is provided to the i-th scan line Si, the first transistor M1 is turned-on. When the first transistor M1 is turned-on, a data signal supplied to the data line Dm is provided to the first node N1. Accordingly, a voltage of the first node N1 drops from a voltage of the reference power supply Vref to a voltage of the data signal.

At this time, a voltage of the second node N2 set as a floating state also drops corresponding to the voltage drop of the first node N1, so that the voltage charged in the second capacitor C2 is stably maintained. The first capacitor C1 is charged with a voltage corresponding to the data signal, which is applied to the first node N1.

Next, as a supply of the emission control signal stops, the fifth transistor M5 is turned-on. When the fifth transistor M5 is turned-on, the second transistor M2 provides an electric current corresponding to voltages charged in the first and second capacitors C1 and C2 to the organic light emitting diode (OLED), so that the organic light emitting diode (OLED) generates light having a luminance corresponding to the current.

As described previously, in the pixel 240 according to the second embodiment of the present invention, while the scan signal is supplied to the (i−2)th scan line Si−2, the gate electrode of the second transistor M2 is initialized with a voltage of the reference power supply Vref. Accordingly, when the pixel 240 are used the gate electrode of the second transistor M2 included in each of the pixels 240 can be initialized with the same voltage. Accordingly, the second embodiment of the present invention may stably compensate for the threshold voltage of the second transistor M2 while the scan signal is being provided to the (i−1)th scan line Si−1. The second embodiment of the present invention is applicable to a panel of large size and high resolution.

As mentioned above, in accordance with embodiments including a pixel, an organic light emitting display, and a method for driving an organic light emitting display using the pixel of the present invention, a threshold voltage of a drive transistor and a voltage drop of a first power supply may be compensated for, thereby displaying an image of substantially uniform luminance. Further, since the embodiments of the present invention initialize pixels using a reference voltage, it can initialize all pixels with the same voltage. In addition, embodiments of the present invention can stably compensate for the threshold voltage of a drive transistor, which supplies a scan signal to one scan line.

Although a few exemplary embodiments of the present invention have been shown and described, it would be appreciated by those skilled in the art that changes might be made to these embodiment without departing from the principles and spirit of the invention, the scope of which is defined in the claims and their equivalents.

What is claimed is:

1. A pixel of a display having columns of pixels, the pixel in a first column of the columns and coupled to a first scan line, a second scan line and a third scan line, the pixel comprising:

an organic light emitting diode;

a first transistor configured to be turned-on when a scan signal is supplied to the first scan line for transferring a data signal;

a second transistor configured to allow an electric current corresponding to the data signal to flow from a first power supply to a second power supply through the organic light emitting diode;

a second capacitor disposed between the first and second transistors, and configured to be charged with a voltage corresponding to a voltage drop of the first power supply and a threshold voltage of the second transistor;

a first capacitor coupled between the second capacitor and the first power supply, the first capacitor being configured to be charged with a voltage corresponding to the data signal;

a fourth transistor coupled between a second electrode of the first transistor and a reference power supply, the fourth transistor being configured to be turned-on when the scan signal is supplied to the second scan line;

a third transistor coupled between a gate electrode and a second electrode of the second transistor; and a fifth transistor coupled between the gate electrode of the second transistor and the reference power supply, the fifth transistor being configured to be turned-on when the scan signal is supplied to the third scan line;

wherein the second scan line is a previous scan line of the first scan line and the third scan line is previous scan line to the second scan line, wherein the second scan line is coupled to a second pixel that is selected prior to the pixel, the second pixel in the first column, and wherein the third scan line is coupled to a third pixel that is selected prior to the second pixel, the third pixel in the first column.

2. The pixel as claimed in claim 1, wherein a voltage of the reference power supply is greater than the voltage of the data signal.

3. The pixel as claimed in claim 2, wherein the voltage of the reference power supply is less than the voltage of the first power supply.

4. The pixel as claimed in claim 1, further comprising a sixth transistor coupled between the second transistor and the organic light emitting diode, the sixth transistor being configured to be turned-on or turned-off according to an emission control signal supplied to an emission control line coupled to the pixel.

5. The pixel as claimed in claim 4, wherein the emission control signal supplied to an the emission control line while the scan signal is being provided to the third, second, and first scan lines, sequentially.

6. The pixel as claimed in claim 1, wherein the scan signals, having substantially the same duration, are supplied sequentially in an order of the third scan line, the second scan line, and the first scan line.

7. An organic light emitting display having columns of pixels, the display comprising:

a scan driver for sequentially providing a scan signal to scan lines, and for sequentially providing an emission control signal to emission control lines;

a data driver for providing a data signal to data lines in synchronization with the scan signal; and a plurality of pixels, each being coupled to one of the data lines and a first, a second and a third scan line among the scan lines, each of the pixels comprises:

an organic light emitting diode;

a first transistor configured to be turned-on when a scan signal is supplied to the first scan line for transferring a data signal;

a second transistor configured to allow an electric current corresponding to the data signal to flow from a first power supply to a second power supply through the organic light emitting diode;

a second capacitor disposed between the first and second transistors, and configured to be charged with a voltage corresponding to a voltage drop of the first power supply and a threshold voltage of the second transistor;

a first capacitor coupled between the second capacitor and the first power supply, the first capacitor being configured to be charged with a voltage corresponding to the data signal;

a fourth transistor coupled between a second electrode of the first transistor and a reference power supply, the fourth transistor being configured to be turned-on when the scan signal is supplied to the second scan line;

a third transistor coupled between a gate electrode and a second electrode of the second transistor; and a fifth transistor coupled between the gate electrode of the second transistor and the reference power supply, the sixth transistor being configured to be turned-on when the scan signal is supplied to the third scan line;

wherein the second scan line is a previous scan line of the first scan line and the third scan line is previous scan line to the second scan line, wherein the each pixel of the plurality of pixels is in a first column of the columns, wherein the second scan line is coupled to a second pixel that is selected prior to the each pixel, the second pixel in the first column, and wherein the third scan line is coupled to a third pixel that is selected prior to the second pixel, the third pixel in the first column.

8. The organic light emitting display as claimed in claim 7, wherein a voltage of the reference power supply is greater than the voltage of the data signal.

9. The organic light emitting display as claimed in claim 8, wherein the voltage of the reference power supply is less than the voltage of the first power supply.

10. The organic light emitting display as claimed in claim 7, where each of the pixels further comprises a sixth transistor coupled between the second transistor and the organic light emitting diode, the sixth transistor being configured to be turned-on or turned-off according to an emission control signal supplied to an emission control line coupled to said each of the pixels.

11. The organic light emitting display as claimed in claim 10, wherein the emission control signal supplied to an i-th emission control line is active while the scan signal is provided to the third, second and first scan lines, sequentially.

12. A method for driving an organic light emitting display comprising a pixel disposed at an i-th horizontal line (where, 'i' is an integer) and in a first column of a plurality of columns of the display, where the pixel has a drive transistor for controlling the flow of an electric current to an organic light emitting diode, the method comprising:

providing a reference voltage to a gate electrode of the drive transistor when a scan signal is supplied to an (i−2)th scan line;

charging a second capacitor with a threshold voltage of the drive transistor when the scan signal is supplied to an (i−1)th scan line;

charging a first capacitor with a voltage corresponding to a data signal when the scan signal is supplied to an i-th scan line; and providing the electric current corresponding to the voltages in the first and second capacitors to the organic light emitting diode, wherein the (i−1)th scan line is coupled to a second pixel that is selected prior to the pixel, the second pixel in the first column, and wherein the (i−2)th scan line is coupled to a third pixel that is selected prior to the second pixel, the third pixel in the first column.

13. The method as claimed in claim 12, wherein the drive transistor controls an amount of the electric current corresponding to the voltages in the first and second capacitors provided from a first power supply to a second power supply through the organic light emitting diode.

14. The method as claimed in claim 13, wherein the reference voltage is greater than the voltage of the data signal.

15. The pixel as claimed in claim 14, wherein the reference voltage is less than the voltage of the first power supply.

16. The method as claimed in claim 12, wherein said charging the second capacitor with the threshold voltage of the drive transistor when the scan signal is supplied to the (i−1)th scan line comprises:

applying a voltage, obtained by subtracting the threshold voltage of the drive transistor from a voltage of a first power supply, to a first terminal of the second capacitor; and applying the reference voltage to a second terminal of the second capacitor.

17. The method of claim 12, wherein said providing the electrical current comprises providing an emission control signal to a gate electrode of an emission control transistor disposed between the driving transistor and the organic light emitting diode.

* * * * *

UNITED STATES PATENT AND TRADEMARK OFFICE

CERTIFICATE OF CORRECTION

PATENT NO. : 8,054,250 B2
APPLICATION NO. : 11/781162
DATED : November 8, 2011
INVENTOR(S) : Yang-Wan Kim It is certified that error appears in the above-identified patent and that said Letters Patent is hereby corrected as shown below:

| | |
|---|---|
| Column 11, Claim 1, line 40. | After "is"<br>Insert -- a -- |
| Column 11, Claim 5, line 61. | After "signal"<br>Insert -- is -- |
| Column 11, Claim 5, line 61. | Delete "an" |
| Column 12, Claim 7, line 38. | After "is"<br>Insert -- a -- |

Signed and Sealed this
Twenty-third Day of October, 2012

David J. Kappos

David J. Kappos
*Director of the United States Patent and Trademark Office*